United States Patent [19]

Jinno et al.

[11] 4,248,312

[45] Feb. 3, 1981

[54] METHOD AND APPARATUS FOR UPWARDLY CUTTING FULL CUTTING FACE OF A SHAFT WITHOUT REQUESTING WORKMEN'S HANDS

[75] Inventors: Takayuki Jinno; Yasuo Kotake; Toshihiro Kikuchi, all of Ohdate, Japan

[73] Assignees: Dowa Mining Co., Ltd.; Koken Boring Machine Co., Ltd., both of Tokyo, Japan

[21] Appl. No.: 895,103

[22] Filed: Apr. 10, 1978

[30] Foreign Application Priority Data

Apr. 28, 1977 [JP] Japan ..... 52/49510
May 31, 1977 [JP] Japan ..... 52/63643

[51] Int. Cl.[3] ..... E21D 3/00

[52] U.S. Cl. ..... 175/57; 175/171; 175/94; 173/152

[58] Field of Search ..... 175/171, 57, 94; 299/31, 33; 173/152

[56] References Cited

U.S. PATENT DOCUMENTS

| | | | |
|---|---|---|---|
| 1,645,766 | 10/1927 | McCulloch et al. | 106/196 |
| 3,703,212 | 11/1972 | Abrahams | 175/171 |
| 3,840,272 | 10/1974 | Crane | 299/33 |
| 4,083,416 | 4/1978 | Still et al. | 175/171 |
| 4,114,698 | 9/1978 | Webb . | |

*Primary Examiner*—William F. Pate, III
*Attorney, Agent, or Firm*—Wenderoth, Lind & Ponack

[57] ABSTRACT

There is provided a method and apparatus for upwardly excavating a shaft through destructible underground rock. The cutting operation is carried out by full face boring without relying on blasting. An operation for supporting the shaft side wall is carried out by means of frame segments loosely following the advance of the bit. The cutting operation and supporting operation are independent from one another. The diameter of the bit is contracted after the cutting operation to allow the bit to be lowered down through the frame segments.

9 Claims, 22 Drawing Figures

METHOD AND APPARATUS FOR UPWARDLY CUTTING FULL CUTTING FACE OF A SHAFT WITHOUT REQUESTING WORKMEN'S HANDS

BACKGROUND OF THE INVENTION

The present invention relates to an underground rock cutting process wherein the full cutting face of a shaft or vertical gallery is excavated upwardly with the side wall of the shaft being supported by shielding. The present invention also relates to the apparatus for carrying out such process.

It is frequently required in underground operations to have shafts developed upwardly. For instance, in black ore deposits, the black ore is frequently found positioned among a clay bed on certain hard and strong underground rock. Therefore, the black ore can not be reached from above but must be dug and conveyed through a rise hole or upwardly directed shaft bottomed on the above-mentioned hard rock.

Various types of processes have been proposed and introduced to establish shaft or rise hole excavation techniques, including the processes referred to below.

Blast and Scaffold System

In this system a scaffold of timbers or the like is piled up close to the roof or upper surface of the shaft. The workman who climbed onto the scaffold, drills blast holes thereon, sets charges of gunpowder and connects electric wire thereto. Then the scaffold is disjointed, the workman seeks shelter and blasting is carried out. After blast gas is blown away, the next cycle of blasting is prepared to start. Under the circumstances wherein the underground rock is of destructible nature, supporters or columns are set on the surface of the side wall to form frameworks therearound.

For the purpose of securing the safety of workmen in the operation of the blast and scaffold process, many attempts have been made which include a half surface blast system and a hand cutting system. But they were not successful in realizing a significant decrease of danger, because in any case the workmen must stay in a dangerous position for a length of time sufficient to carry out necessary works. The blast and scaffold system involves other problems such as inefficiency caused by an increased number of workmen.

Up and Down Table System

Recently the up and down table system was introduced to improve the situation. In this system a table adapted to be raised and lowered by means of hydraulic power is used to perform the cutting operation, and a raise climber enables the table to be driven from outside of the shaft up to the top surface thereof.

While the raise climber increased the safety in operation by mounting a cage or a roof thereon, and also augmented the efficiency of conveyance, blasting and framing have to be carried out in the heightened position and, therefore, the problem of securing the safety for workmen still remains unsolved. So long as blasting is used in the cutting operation, blast gas must be blown away and the side wall formed must be smoothed, both of which the delay the operation. Further, the problem of securing skilled workmen is severe.

Rise Boring System

The cutting system which employs a rotary cutting bit and is called a rise boring system was proposed and developed with a view to dissolve the above-mentioned problems. In this system, a small hole or pilot hole is drilled from either the ground surface or the upper level to the lower level through underground. A large size boring bit is fitted to the end of a combination of boring rods projecting into the level or ground surface at the side remote from a boring machine. In operation, the bit is rotated and is forcibly drawn toward the boring machine to enlarge the pilot hole in diameter.

The system of rise boring admittedly brought about significant progress in securing safety and also in improving efficiency of excavation because according to this system it is not necessary for workmen to enter into the shaft and further because it results in a smooth side wall.

However, this system of rise boring also has an inherent difficulty because this system requires two opposite chambers, one for the bulky boring machine and the other for discharging cut out materials and, therefore, frequently prevents the location of the shaft at the position most suitable from the standpoint of a coordinate plan of a mine or factory. This kind of disadvantage is especially great when an undeveloped district is required to be exploited, and the excavation in such district inevitably relies upon upward cutting with blasting.

A further disadvantage of the rise boring system is that, because this system does not provide for support of the side wall during the boring operation, the shaft as excavated is deformed by loosening of rocks to an extent unsuitable for use as a shaft. In the case of destructible rock, a deadlock may occur by the jamming or holding of the boring bit during the cutting operation.

Besides the three systems mentioned above, there is a proposed system which uses a cutting machine for upward full surface cutting without supporting the side wall of the shaft. But in this system the use of support frames during cutting operation is not allowable and, therefore, fails to eliminate the defect of the rise boring system. Further, in the shaft developed by this type of machine, the completed shaft has the rock surface exposed directly to air and, therefore, does not allow the workmen to enter thereinto from the viewpoint of safety, thus making the shaft unsuitable to be used for exploitation.

SUMMARY OF THE INVENTION

It is therefore the main object of the present invention to provide a method and apparatus for carrying out an upwardly directed full face excavation accompanied by shielding in order to eliminate the above-mentioned defects of the prior techniques.

According to the present invention, full face cutting of underground rock is effected upwardly from a predetermined position in a gallery or level. Supporting or framing on the side wall can directly follow the cutting or boring, thus making it possible to excavate an upwardly directed shaft in destructible underground rock which can not be excavated in accordance with the prior techniques.

According to the present invention, upwardly directed full face cutting accompanied by shielding can be carried out without requiring the direct presence of workmen and the space or chamber positioned ahead in the direction of cutting, and the workmen are absolutely free from danger when they pass through the shaft.

For the sake of caution it is remarked that the term "full face upward cutting" means such a process wherein the excavation of an upwardly directed shaft can be effected in a single cycle and in turn does not mean a process wherein a shaft is gradually enlarged in its diameter by first drilling a pilot hole.

Thus the method according to the present invention comprises the step of full face upward cutting of a shaft of predetermined length by means of a rotary bit and the step of supporting the resultant side wall by means of a circular iron frame, whereby both steps are carried out alternately and repeatingly. In other words, excavation is carried out using a rotary bit while supporting the side wall by a circular iron frame.

For carrying out the method of the present invention, the present invention provides an apparatus for upwardly excavating a shaft without requiring the direct presence of workmen, which comprises a series of drill rods, a bit mounted on the top of the series of rods, a series of frame segments for supporting the side wall of the shaft, means for upwardly thrusting and rotatingly driving the series of drill rods, means for upwardly thrusting the series of frame segments independently of the means for thrusting and rotatingly driving the series of drill rods, means for contracting the diameter of the bit and means for supporting the roof to support the same when thrusted to the roof.

BRIEF DESCRIPTION OF THE DRAWINGS

Other objects and advantages will further be clarified by the explanation below with reference to the accompanied drawings wherein:

FIGS. 17*a* and 17*b* are half sectional views of a bit, illustrating means for changing the diameter of the bit, wherein FIG. 17*a* is of normal appearance while FIG. 17*b* is contracted.

DETAILED DESCRIPTION OF THE INVENTION

Figure 1:
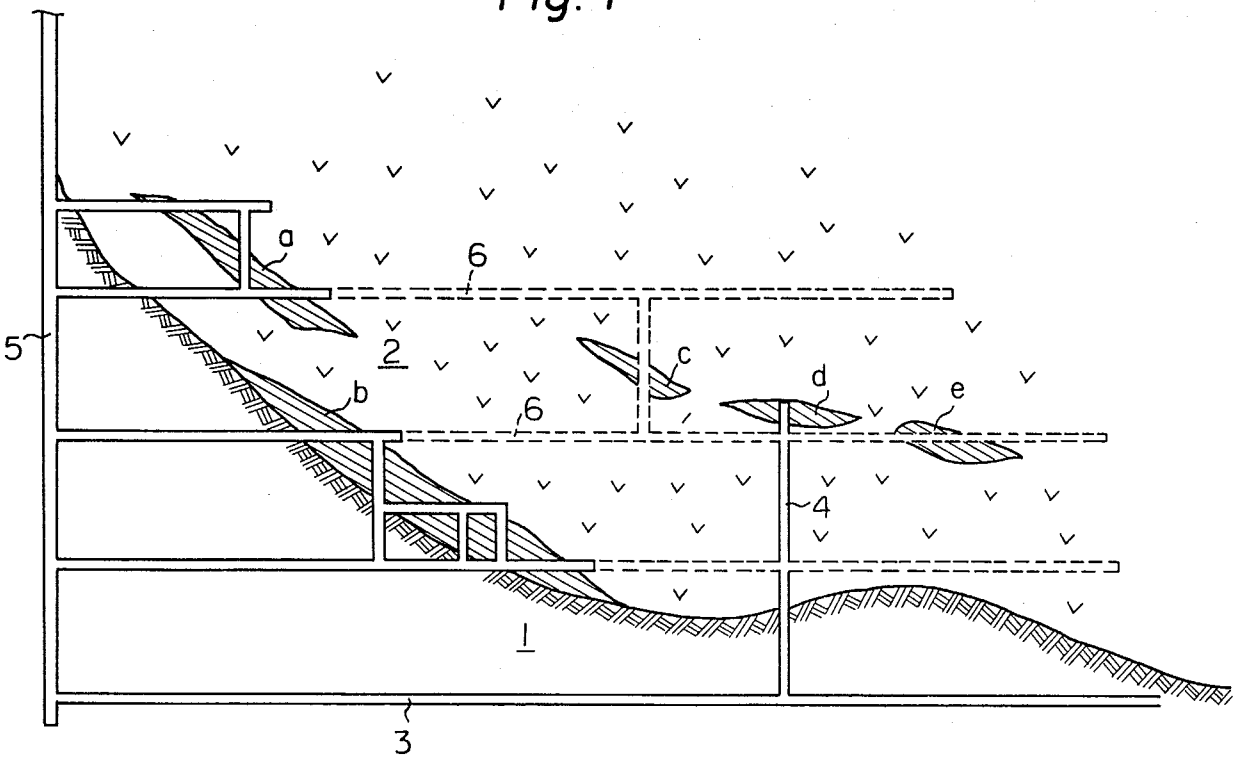
FIG. 1 is a general cross section of an example of a mining plant to which the present invention is applicable.

In FIG. 1, black ore deposits c, d and e are shown as being deposited not in hard rock 2 but in destructible rock, and are required to be approached from beneath through an upwardly directed shaft 4, because it is difficult to reach these ores through a long level or horizontal gallery. For the purpose of a supporting side wall subjected to destruction the present invention uses a plurality of circular frame segments of predetermined length. As the rotary bit advances, additional frame segments are joined to the lower end of a series of frame segments, and the entire group of segments are thrust upwardly to support the side wall of the thus advanced portion. Before the addition of new frame segments, the former series of frame segments is temporarily supported by neighbouring rock or otherwise held by suitable means such as a tie rope.

After the shaft is excavated along its entire length, the roof or the uppermost surface of the shaft must be supported to prepare for the excavation of a level therefrom. While the rotary bit located at the roof may itself be used as a support therefore, such retention of the bit is of course undesirable and the existence of stabilizer and the like makes the excavation of the level difficult.

To attain this object of roof supporting, it was found advantageous to contract the diameter of the bit to enable the bit to be lowered through the series of frame segments. Then a top support tool replaces the bit and is thrust up to the roof as a support therefor. Preferably the top support tool is of the type which stretches in an umbrella like manner when thrust.

Figure 2:
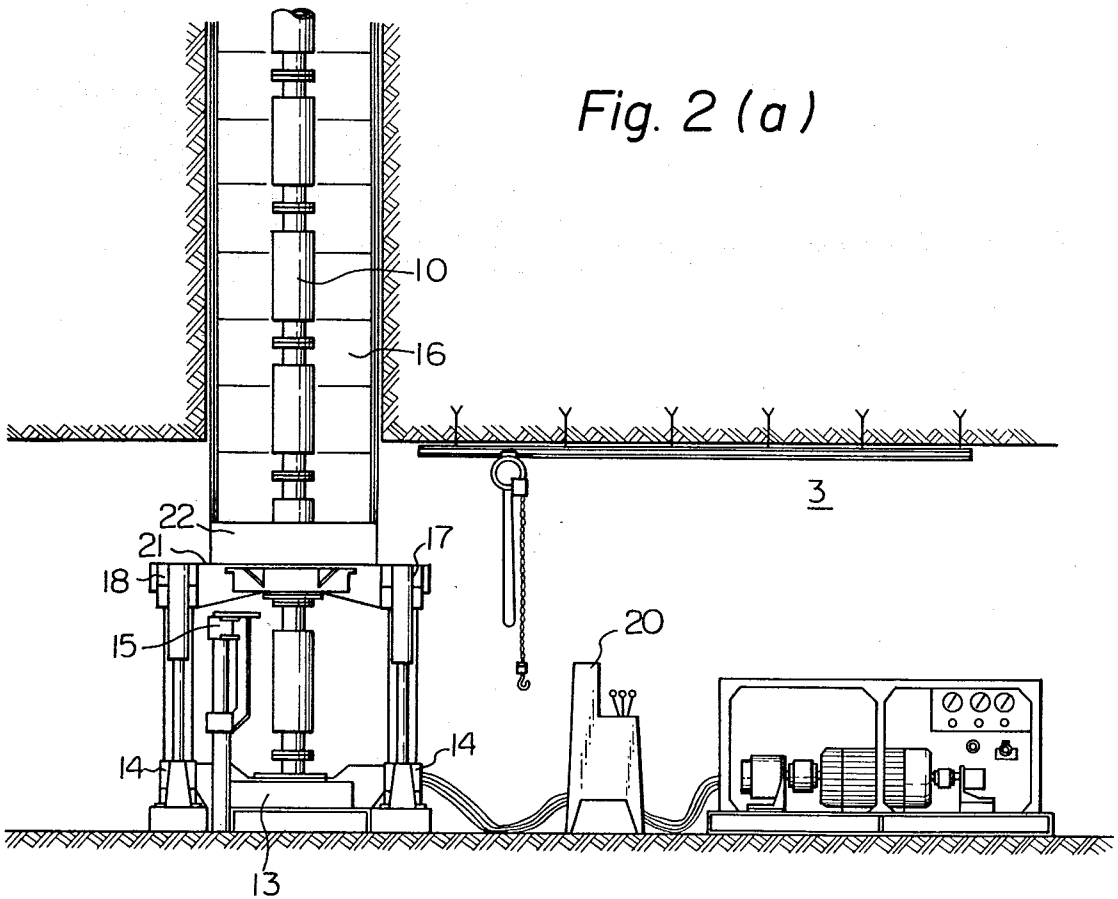
FIGS. 2(*a*) and 2(*b*) are general side views of the apparatus for carrying out the process of the present invention.
Figure 2B:
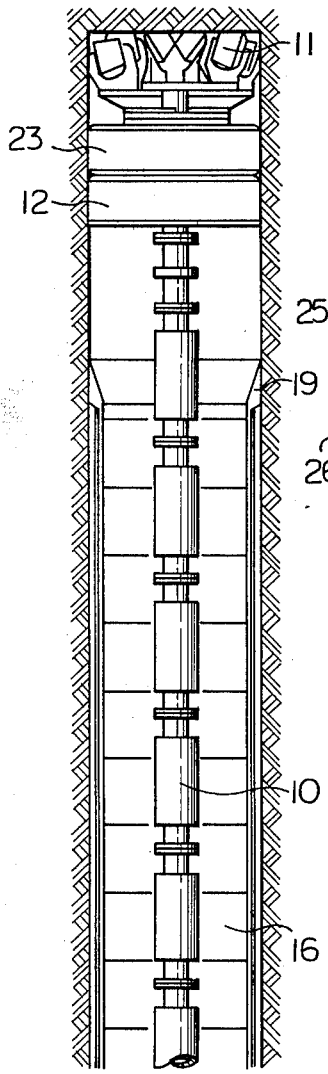
Figure 3A:
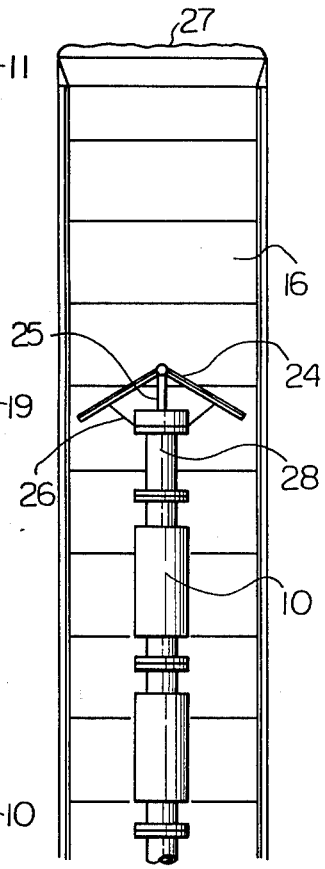
FIGS. 3(*a*) and 3(*b*) illustrate a device for supporting the roof after cutting.
Figure 3B:
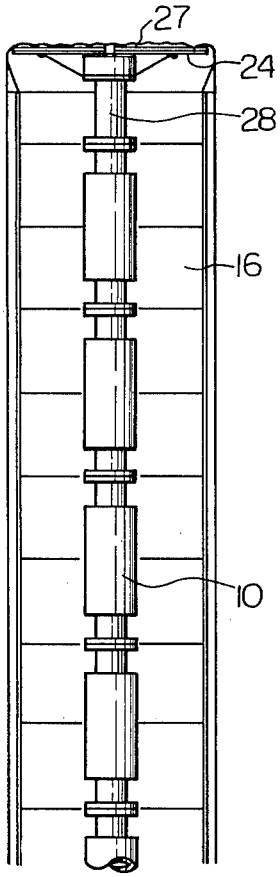

Excavation of the shaft is carried out by a bit assembly 11 mounted on a series of drill rods 10, see FIGS. 2(*a*) and 2(*b*). The bit assembly 11 has a plurality of cutters and is made contractible. Under the bit assembly 11, is there a bit stabilizer 12 which is also made contractible. The stabilizer 12 is thrust up along and in contact with the side wall formed to prevent the vibration of the drilling rods.

The series of drill pipes 10 consists of successively connected drill rods of uniform length, and the lowermost rod is connected to a power head 13 which drives and rotates the series of rods and which is supported by two hydraulically driven thrust cylinders 14. The power head 13 is raised by the distance corresponding to the length of a drill rod. Then a rod holder (not shown) is actuated to hold the series of rods 10, and the power head is lowered apart from the series of rods. A new pipe unit is mounted on the power head 13 and is driven up to the lower end of the series of drill rods 10 and is connected thereto by the rotary movement of a drill rod positioner 15. In this manner the excavation or cutting operation is repeatingly carried out.

An operation for thrusting up a series of circular iron frame segments 16 is carried for supporting the thus shaped side wall following the above-mentioned excavation. The series of the frame segments 16 consists of successively connected frame segments each of which may be divided into several members. There are four means 17,17 and 18,18 for thrusting up the series of frame segments independently of aforementioned thrust cyllinders 14. While in FIG. 2(*a*) the frame segment thrust means 17 are shown as overlapped with the thrust cylinders 14, the former are spaced from the latter in directions vertical to the plane of the drawing and can be driven independently. A base member 21 is thus supported by four cylinders 17,17 and 18,18.

When one or more circular iron frames are to be added, the lower end of the formerly constructed series of iron frames 16 is supported on the neighbouring rock or otherwise held by means such as a tie rope, and the frame segment thrust means 17, 18 effect lowering of the base member 21. With the base member lowered, a new frame segment is shaped by joining several members and is connected to the lower end of the formerly combined series of frame segments 16. Thereafter the frame segment thrusting means 17, 18 are altogether actuated to raise the newly combined series of frame segments by the distance corresponding to the height of added frame segment.

At the uppermost of the series of circular iron frame segments 16, a blade member 19 is mounted so as to guide the series 16 to be raised vertically without suffering abrasion by the uneven surface of the cut out side wall. The blade member 19 is larger in diameter than the frame segment, and so prevents plugging by cut out powders in the annular part between the frame 16 and the side wall to enable the series 16 to be driven up smoothly.

The operation for thrusting the series of frame segments 16 and also the operation for thrusting the series of drill rods can be carried out without requiring the workmen to enter into the underneath of the shaft, because of the presence of a control unit 20.

The cut out powders which fall down are piled on the base member above the boring machine, but are removed therefrom by a rotatable scraper impeller 22 down through openings (not shown) in the base member 21 and are transferred to a belt conveyor in the level.

When the excavation or cutting operation is terminated, the bit assembly 11 and the bit stabilizer 12 are both contracted in diameter to become smaller than the inside diameter of the series of frame segments 16. Then each of the drill rods 10 is disconnected in the inverse order to finally withdraw the bit assembly 11 and the bit stabilizer 12.

Numeral 23 in FIG. 2(*b*) indicates a leading air pack which serves to support the side wall between the bit assembly 11 and the bit stabilizer 12 by means of pressurized air.

When it is necessary to support the roof which is disposed to open air after the above-mentioned disjoining operation, a top support tool 24 is mounted on the top of the series of drill rods 10. This tool 24 is contractible and stretchable in an umbrella like manner and, when positioned at the roof by succeedingly joining the rods, is full stretched by retracting a stem 25 into a top cylinder 28.

Next, the underground rock cutting system according to the present invention will be further explained in detail to illustrate the preferred embodiments thereof.

Figure 4:
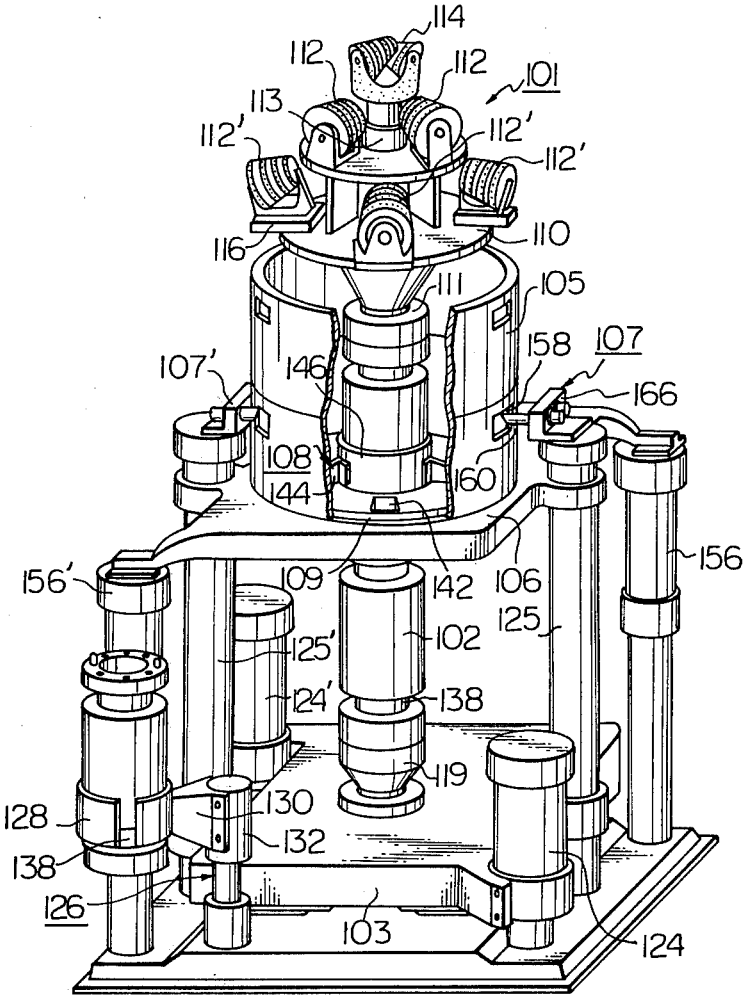
FIG. 4 is a perspective and general view of the apparatus according to the present invention.

In FIG. 4, a bit indicated generally by reference numeral 101 comprises a bit carrier 110 having several carrier plates spaced apart by a predetermined distance and connected by center pole 113 located at the center of each of the carrier plates, a sub rod 111 connected to the center of the under surface of the bit carrier 110, a center cutter 114 mounted on the opening of a slot positioned at the top of the bit carrier 110, a plurality of roller cutters 112 and 112' mounted at predetermined positions on the carrier plates, each of the carrier plates having several cutters.

According to the example of FIG. 4, the center cutter 114 is of the type of tricon bit having three spaced apart bit members, the top of each of which is directed to the center to allow rotary movement in operation, as is well known in oil well drilling techniques. The roller cutters 112 and 112' are of the type of frusto conical cutters, and the centers of opposite circles or ends thereof are supported to enable the cutters to rotate.

On the side surface of these roller cutters 112, 112' and the center cutter 114, there are cutting teeth which contact to the rock surface to effect rock cutting when the bit 101 is rotated and pushed up. At that time, each of the cutters is driven to effect rotation thus prolonging the life of these cutters because the cutting action is carried out uniformly with respect to each of the teeth.

In detailing the cutting operation carried out by the bit 101, a guide hole or pilot hole of small diameter is formed through rotary and push-up performance of the center cutter 114. This guide hole is gradually enlarged by means of previously mentioned roller cutters 112 and 112' on the carrier plates, as these cutters are rotated and pushed up to finally form the shaft of intended diameter. Since the center of the center cutter is aligned with the center of the group of the roller cutters, the axis of the guide hole coincides with the axis of the excavated portion of the shaft and, therefore, the axis of each of the enlarged holes also coincides with the axis of the guide hole. This prevents generation of bends during excavation.

Since as will be explained hereinafter, frame segments 105 will have been pushed up close to the bit 101 when the cutting operation is terminated, and further since the outside diameter of the bit 101 is larger than the inside diameter of the frame segments 105, it is necessary for the bit 101 to have some contraction mechanism for enabling the bit 101 to be lowered through the set of segmental support frames.

An example of the contraction mechanism is shown in FIG. 4. Lowermost roller cutters 112' are secured to movable cutter plates 116 each being fixed to the lowermost carrier plate of the bit carrier 110 by means of a pin. The cutter plate is allowed to rotate around the pin.

During the cutting operation the movable cutter plate 116 is secured to the lowermost carrier plate by bolts and projects outwardly therefrom. When the cutting operation is terminated, the bolts are detached and the movable cutter plate 116 is rotated around the pin to allow the roller cutters 112' to be shifted into another predetermined angular position, whereby the roller cutters are tightened by bolts to cause contraction of the size of bit 101.

Since at the time of contraction, the side wall is supported by segmental frames 105 and the upper cutting face is protected by the bit 101, workmen can safely pass through the shaft to effect such a contraction. An extendable ladder provided on each of the series of segmental frames 105 is used by workmen in their passing up and down therethrough.

The center pole 113 of the bit carrier 110 is hollowed and has several slots pierced on the side surface thereof, which slots serve to blow out compressed air through the rods 102 to ventilate the shaft during manual operation.

Another contraction mechanisms can be used. For example, there is a system of connection wherein the movable cutter plate 116 is allowed to swing upwardly and downwardly, whereby contraction can be attained when swung downwardly. Automatic contraction systems may be used, wherein the roller cutter 112' is moved by controlling the compressed air or otherwise a wire rope is connected to the movable cutter plate 116 through the rods 102 to enable the workman to contract the bit without passing through the shaft.

In FIG. 4, the rods 102 are shown cylindrical and are securely connected to one another. The rods 102 serve to connect the rotary drive head 119 on the rod thrust means 103 with a sub rod 111 connected to the lower part of the bit 101. Thus the rods 102 support the bit 101 and transmit torque and thrust force to the same. The slot or conduit formed in the rods 102 is the passageway through which the compressed air is supplied from the upper hollowed portion of the rotary drive head 119 to the openings of the center pole 113 in the bit 101, thus ventilating the uppermost portion of the shaft.

Figure 5:
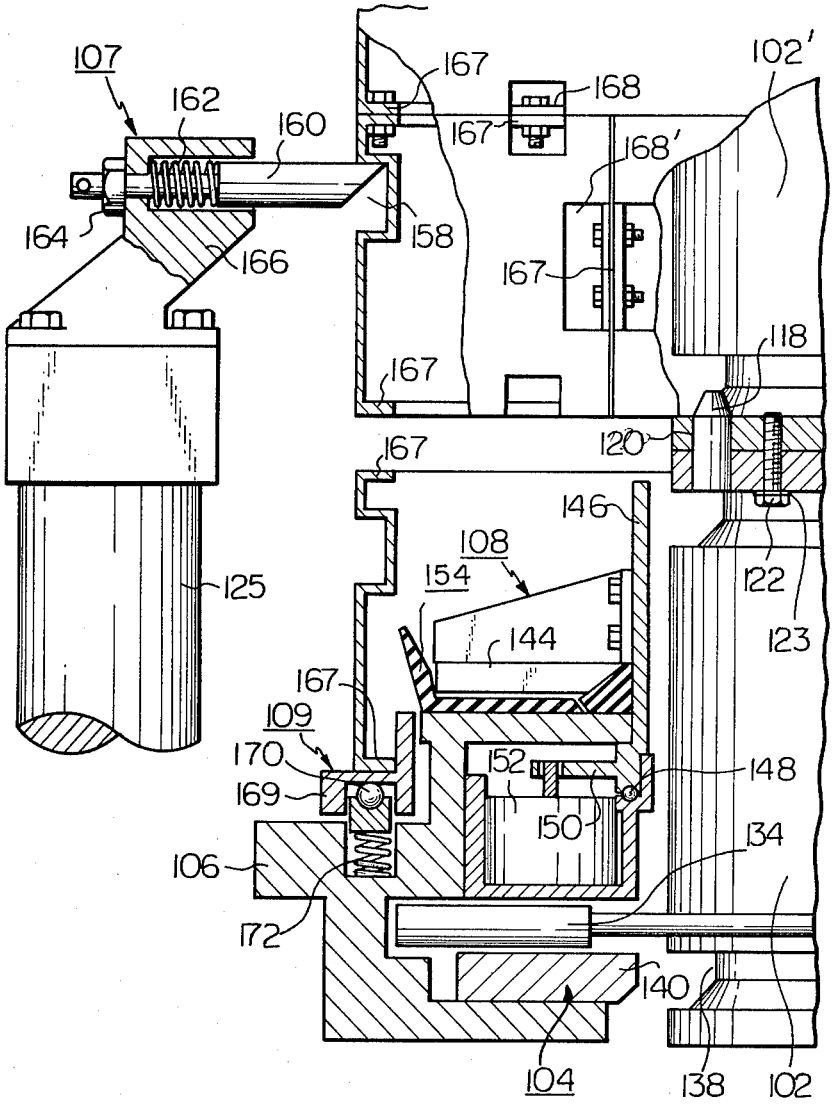
FIG. 5 is an enlarged fragmental view illustrating a rod joining means, a rod holder, a frame segment holder and the device for rotating the frame segments.

As shown in FIG. 5, a rod 102 is brought into the position adapted to be connected with an upper rod 102', when a pair of set pins 118 on the rod 102 are inserted into a pair of slots 120 at the lower end of the rod 102'. High tensile strength bolts 122 are tightened to complete the junction of the rod 102' with the rod 102. A spring washer 123 is used to prevent loosening of the bolts. A rubber O ring is located between the two rods to prevent leakage of compressed air therethrough. The two rods 102 and 102' may also be joined by way of providing a male screw and female screw, which will be tightened by rotating the rotary drive head 119.

Rod thrust up means 103 shown in FIG. 4 comprises a rotary drive head 119 for rotating the rods 102, and is raised and lowered by means of a pair of hydraulic cylinders 124 and 124'. By the term "hydraulic cylinder" is meant a system of hydraulically actuating a piston rod in a cylindrical member one end of which is closed. The torque or rotary force of the rotary drive head 119 is derived by the hydraulic motor enclosed in the rod thrusting means 103. The term "hydraulic motor" means the device for converting hydraulic flow into torque. The rod thrust up means 103 is vertically reciprocated along columns 125 and 125' serving as guide means.

Reference will next be made to FIG. 5 to FIG. 10 inclusive, wherein there is illustrated the mechanism of upward excavation and the mechanism of joining a new rod. There is also illustrated the detail of a rod holder 104 for momentarily holding the series of rods 102 and a rod positioner 126 for transferring a new rod 102' onto the rotary drive head 119.

Figure 6:
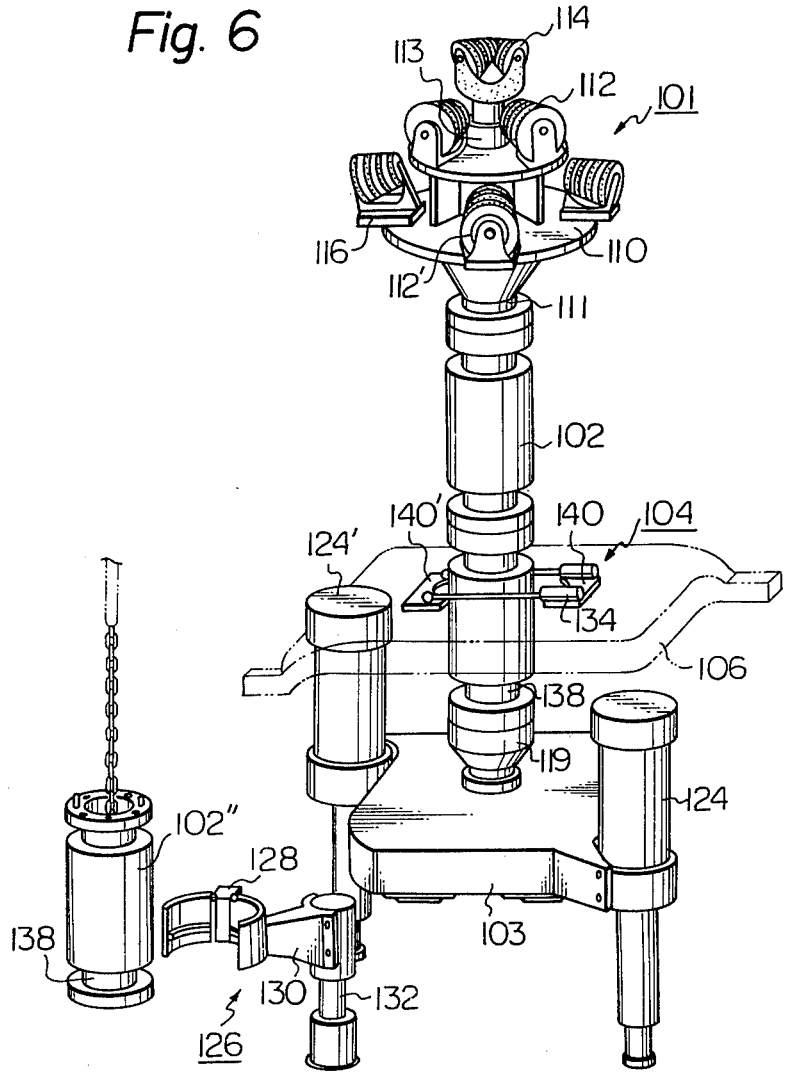
FIGS. 6 and 10 inclusive are perspective views which explain in detail the process of joining rods and the device for holding rods.

In FIG. 6, the rotary drive head 119 in the rod thrusting means 103 drives the bit 101 to rotate by the rods 102, and the hydraulic cylinders 124, 124' thrust up the bit 101 also by the rods 102. By virtue of the rotary force and the thrust force thus obtained, the bit 101 cuts out underground rock and advances upwardly until the piston rods in the cylinders 124 and 124' reach upper dead points. Then the series of rods 102 is held by a rod holder 104, which is mounted on a frame segment thrusting means 106 and is comprised of holding plates 140, 140' and a hydraulic device 134 for these two holding plates. As shown in FIG. 5, the holding plates 140, 140' are supported and guided by a frame 106, although the plate 140 alone is shown. The rod holder is designed to open and close by means of the drive force of the hydraulic cylinder 134. FIG. 6 shows the rod holder 104 in the open condition.

The rod positioner 126 comprises a gripper 128 for gripping a new rod 102" at its lower depression 138, an arm 130 for transferring the thus gripped rod in circular movement and a pillar 132 for rotatably supporting the arm 130. The gripper 128 opens and closes by a hydraulic cylinder enclosed therein so as to automatically hold and release the rod 102".

Figure 7:
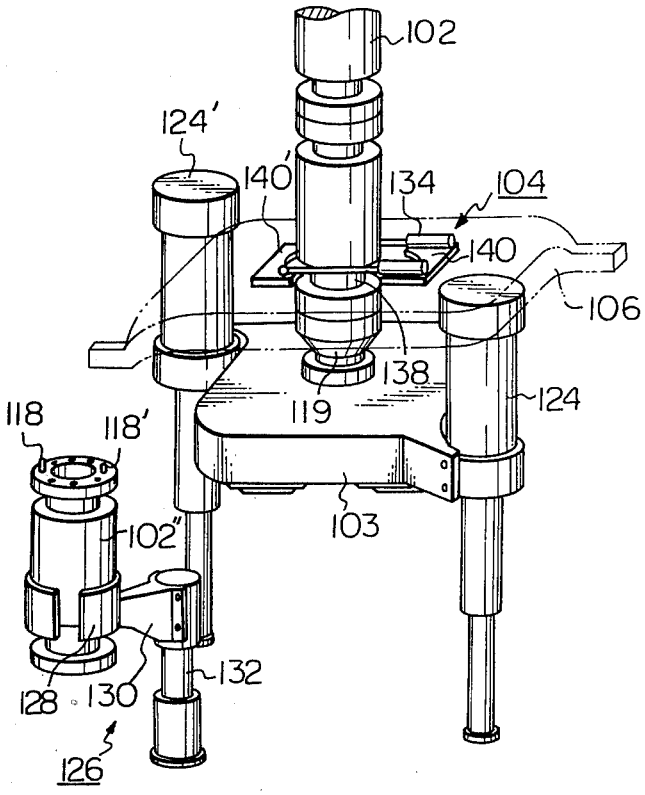
Figure 8:
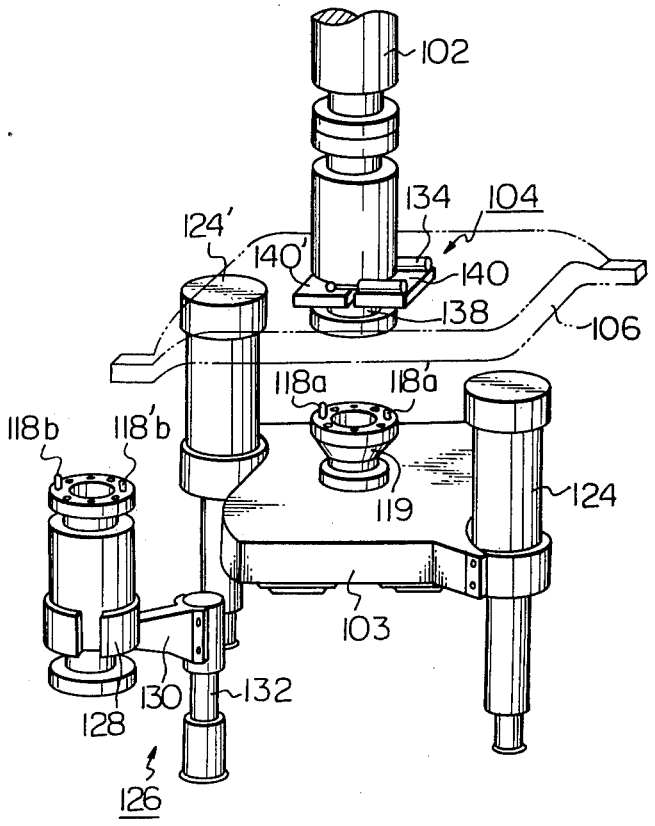
Figure 9:
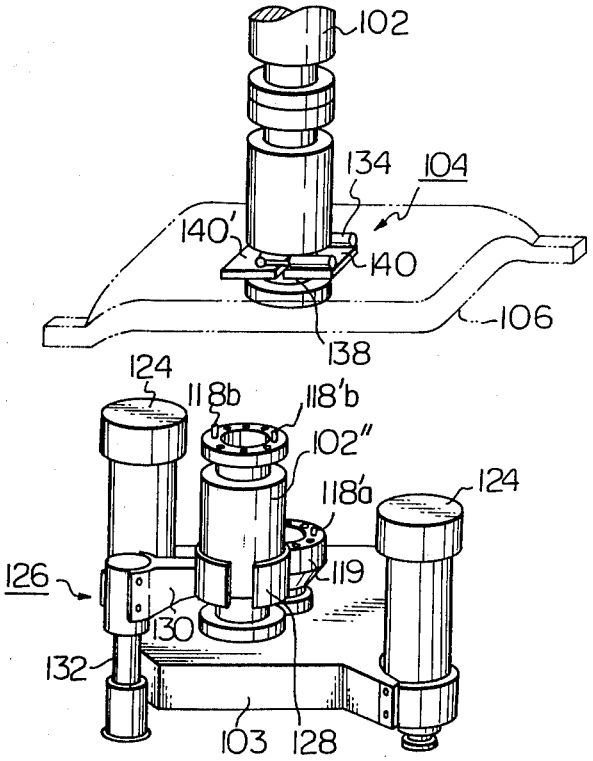

In FIG. 7, the rod 102" is shown as gripped by the gripper 128, and rods 102 are shown as located at the upper dead point where rods 102 can not be further raised. When, under such circumstance, the hydraulic cylinder 134 is actuated, the aforementioned plates 140, 140' will pinch the lower depression 138 of the lowermost rod. In turn the holding plates support the whole series of rods 102. Thereafter, high tensile strength bolts which connect the rotary drive head 119 with the rods 102 are loosened, and the series of rods 102 is thus secured only to the rod holder 104 as shown in FIG 8. Rod thrust up means 103 is then lowered to separate the rotary drive head from the lowermost rod. When the hydraulic cylinders 124 and 124' reach lower dead points, rod thrust means 103 will be stopped as shown in FIG. 8.

Then arm 130 of the rod positioner 126 is swung around the pillar 132 to transfer the rod 102" onto the predetermined position on the rotary drive head 119. As shown in FIG. 8, two upwardly projecting pins **118*a* and 118*a'*, one being longer than the other, are provided on the upper edge of the rotary drive 119. In order to have alignment of the rod 102" with upper rods 102, the rotary drive head 119 is rotated slowly, and simultaneously the rod thrust means 103 is slowly pushed up to have alignment of the longer pin 118*a* with a corresponding slot at the lower edge of rod 102. Since the pin 118*a* is tapered, the rod 102" can be located exactly onto the predetermined relative position with respect to the drive head 119 owing to the fine adjustment carried out therebetween. The rod 102" is then rotated around the pin 118*a* as a center, and the shorter pin 118'*a* is registered with the other slot in the rod 102"**.

Thereafter, the rod thrusting means 103 is further raised, and consequently the rod 102" slides on the tapered portion of shorter pin **118*a* to complete an exactly aligned junction with the upper edge of the rotary drive head 119**.

The above-mentioned way of joining eliminates the fine and troublesome adjustment of registering the rod 102" with the rotary drive head 119, which would be inevitable in the case of an bolt tightening connection.

Figure 10:
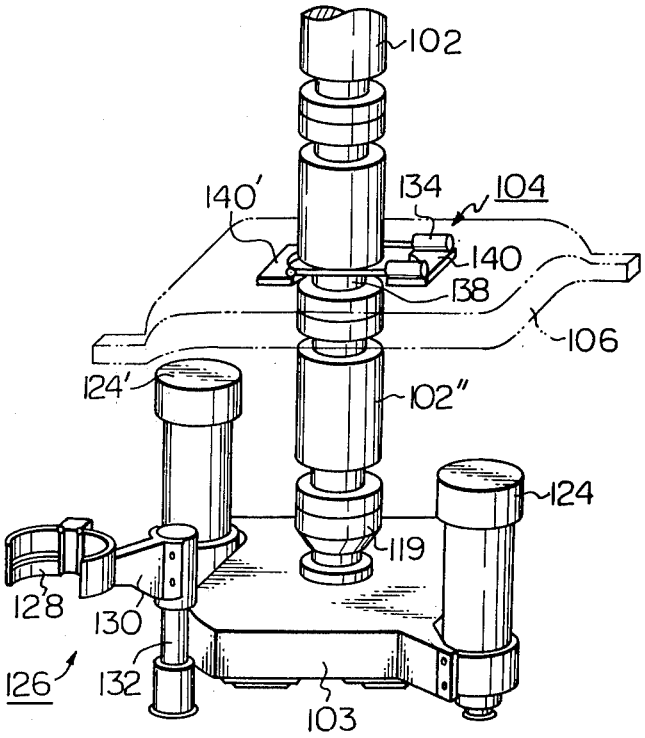

Then the rod 102" is connected to the upper rods of the series of drill rods 102. Two tapered pins **18*b* and 18*b'*, one being longer than the other, are alike mounted on the upper end of the rod 102", and bolt slots may be registered exactly without fine adjustment. The gripper 126 of the rod positioner releases the rod 102", and high tensile strength bolts are tightened on the upper and lower ends. Finally the rod holder 104** is released to complete the preparation for a succeeding cutting operation as shown in FIG. 10.

According to the example shown in FIG. 4, a cut out material discharge means 108 comprises two scraper plates 144 which rotate on the upper surface of the rod thrusting means 106 around the rods 102, and a cylindrical member 146 combined with the scraper plates 144 for transmitting rotary drive force thereto.

As detailed in FIG. 5, the cylindrical member 146 is supported by the frame segments of thrusting means 106, with bearing balls 148 therebetween so that the cylindrical member 146 may rotate freely. Gears 150 are connected to the lower end of the cylindrical member 146 to transmit rotary drive force of a hydraulic motor 152 to the scraper plates 144 through the cylinder member 146.

The series of frame segments 105 serves as means for preventing dispersion of cut out materials during the cutting operation as a characteristic aspect of the present invention. The cut out materials fall down the series of frame segments 105 and are piled up together on the upper surface of the frame segments thrusting means. For baffling the shock of falling material, the upper surface of the thrusting means 106 is covered by a rubber plate 154. The materials which fall on the thrusting means 106 are scraped together by the scraper 144 during rotary movement thereof, and in turn are discharged from the shaft through a shoot slot 142. Although not shown in FIG. 4, a shoot pipe is located under and connected to the shoot slot 142 for transferring the cut out materials onto a belt conveyor and the like, at the same time preventing dispersion of powdered materials therearound.

As shown in FIG. 4, the frame segments thrusting means 106 comprises a cut out material conveyor 108, the rod holder 104, and a frame segments turning device 109 which will be described hereinafter. Hydraulic cylinders 156, 156' drive the thrusting means 106 upwardly and downwardly along the guide pillars 125 and 125' to make it possible for the frame segments 105 to be fabricated thereon and to be pushed up into the shaft.

Reference is made to FIG. 11 to FIG. 16 inclusive for detailing the system of joining a new frame segment and the system of thrusting it up. The function of each of the frame segments 105, a frame segment holder 107 and the frame segment 105 turning device 109 will also be clarified.

Figure 11:
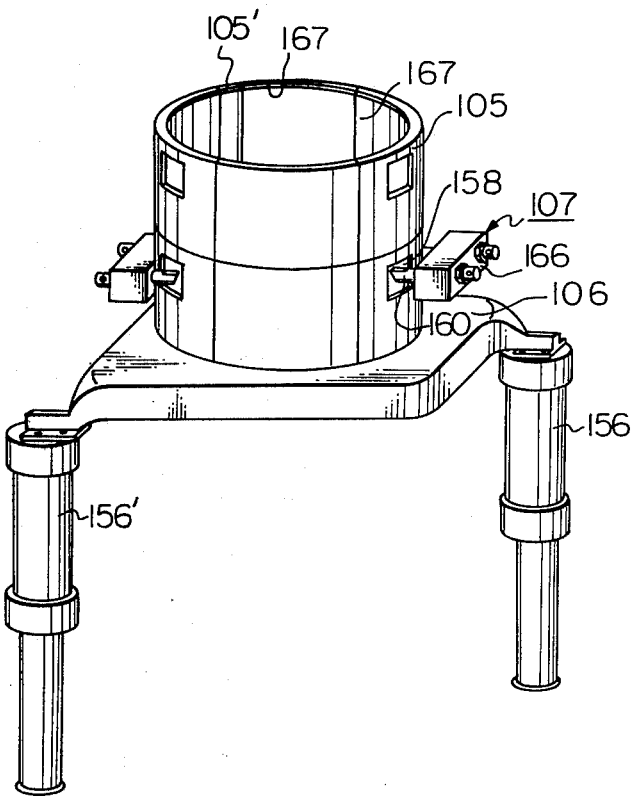
FIGS. 11 to 16 inclusive explain the device for joining frame segments and the structure of the frame segment holder.
Figure 12:
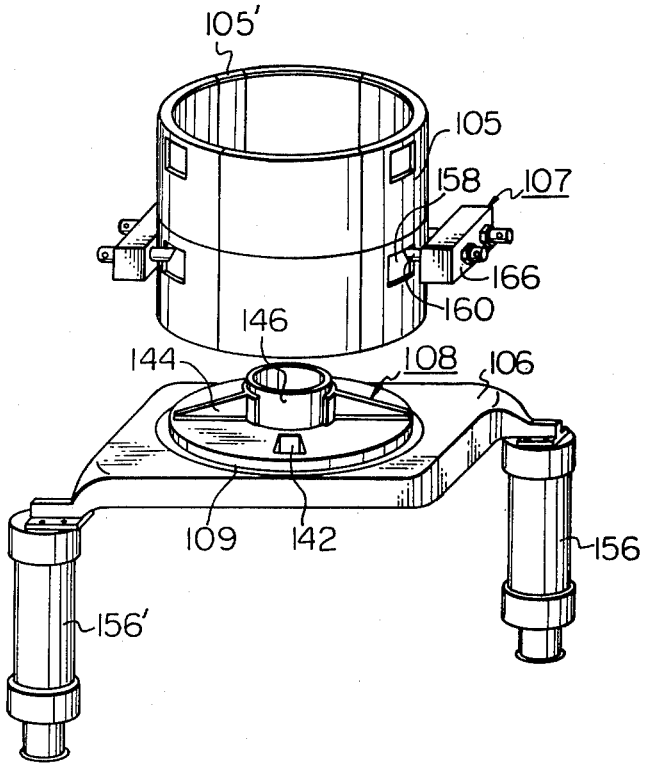
Figure 13:
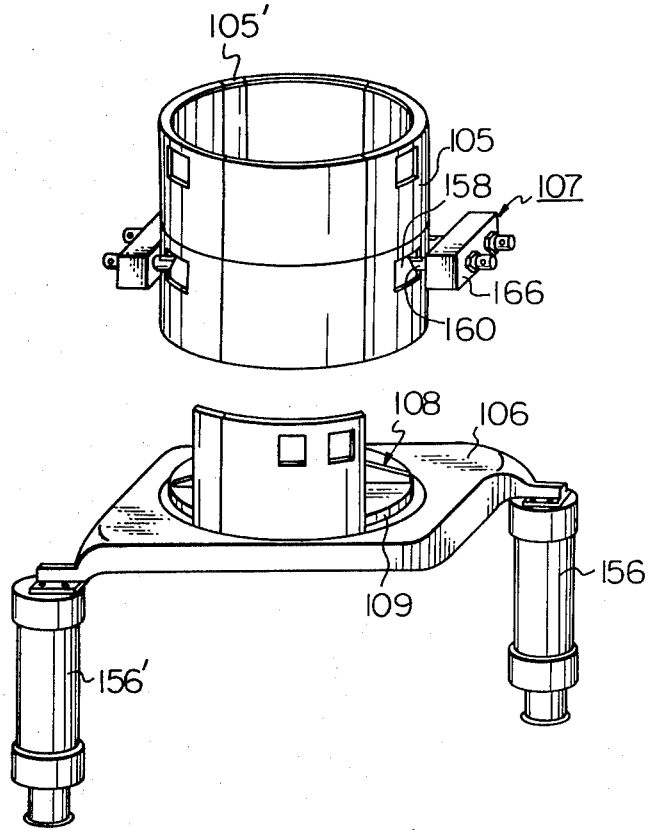

As shown in FIG. 11, the frame segment has depressions 158 on the side surface thereof, each receiving a holder rod 160 of the frame segments holder 107. As shown in FIG. 5, the holder rod 160 which is a bolt fastened to the pillar 125 is biased toward the side wall of the frame segment 105 by means of a spring 162. Therefore, under the condition in FIG. 11, the frame segments holder 107 does support the series of frame segments which are connected in vertical series, and will remain in the same position irrespective of the downward movement of the frame segment thrusting means 106, thereby attaining detachment of the frame segment 105 from the thrusting means 106. When, as shown in FIG. 13, the hydraulic cylinders 156 and 156' reach the lowermost levels thereof, the frame segment thrusting means 106 is stopped at its lowermost position to allow a frame 105 to be added.

The frame segment 105 is a type of cylinder adapted to support the side wall of the excavated shaft, and is comprised of more than two arcuate members which are separatable in the longitudinal direction. To secure the safety of workmen, the fabrication of these arcuate members should be carried out with the workmen at the outside thereof. To accommodate such a requirement, the connecting plane of each of the members are sloped in the radial direction to facilitate the fabrication from outside.

Although the shaft excavated in accordance with the process of full face upward cutting without requiring workmen according to the present invention generally fills its role satisfactorily in mines or other engineering factories, it is sometimes required for the excavated shaft to be enlarged in its diameter, which necessitates the disassembly of the fabricated segments 105 from inside beginning from the uppermost segment.

To fulfill this requirement the arcuate members include at least one disjointable member 105' which has its connecting planes or cutting surfaces on both sides sloped to form acute angle edge at the inner surface thereof to allow the disjointable member 105' to be readily withdrawn inwardly.

Inwardly projecting peripheral flange members 167, 167 shown in FIG. 5 are connected to each other by bolts, and may be disengaged from the inside by loosening the bolts. Owing to such a way of joining, the bolts can be detached from inside at the time of disjoining the frame segment.

Since the bolt should be manipulated from outside at the time of joining from the standpoint of safety, each of the arcuate members has openings 168 which are positioned adjacent the bolt slots to enable insertion of bolt-nut units therethrough to effect tightening thereof.

With reference to FIG. 13, one of the arcuate members is laid on the frame segment turning means 109 or circular table on the frame segment thrusting means 106.

The arcuate member is then horizontally shifted by rotation of the frame segment thrusting means to allow the succeeding arcuate members to be brought in. With the last of the arcuate members brought in, a new frame segment 105'' is completed. Then the hydraulic cylinders 156 and 156' are actuated to raise the frame segments thrusting members toward the bottom of the upper series of the frame segments 105 to join the new segment 105'' thereto.

It will be understood that, after joining in the aforementioned way, the frame segments thrusting means must withstand the entire load of thus prolonged series of frame segments and the abrasion between the frame segments and the side wall of the shaft during further upward movement thereof.

The construction of means for rotating the segmental frame is explained hereinbelow with reference to FIG. 5. The frame rotating member 109 comprises a rotary fabrication base 169 and bearing rollers 170 for smooth rotary movement as well as springs 172 received in depressions on the frame segment thrusting means 106 for supporting the rollers 170.

So long as the load imposed upon the rotary fabrication base 169 is within a predetermined extent, the fabrication base 169 will not contact with the upper surface of the segment thrusting members 106 and will be allowed to freely rotate since the load can be absorbed by the springs 172 through the rollers 170. However, when the magnitude of the load exceeds a predetermined extent, springs 172 will be contracted considerably and will cause contact of fabrication base 169 with the upper surface of the thrusting means 106. Thus, the thrusting means 106 must carry the excessive load which generates friction force therebetween and which prevents the series of frame segments from rotation. However, the bearing rollers are free from rupture.

Figure 14:
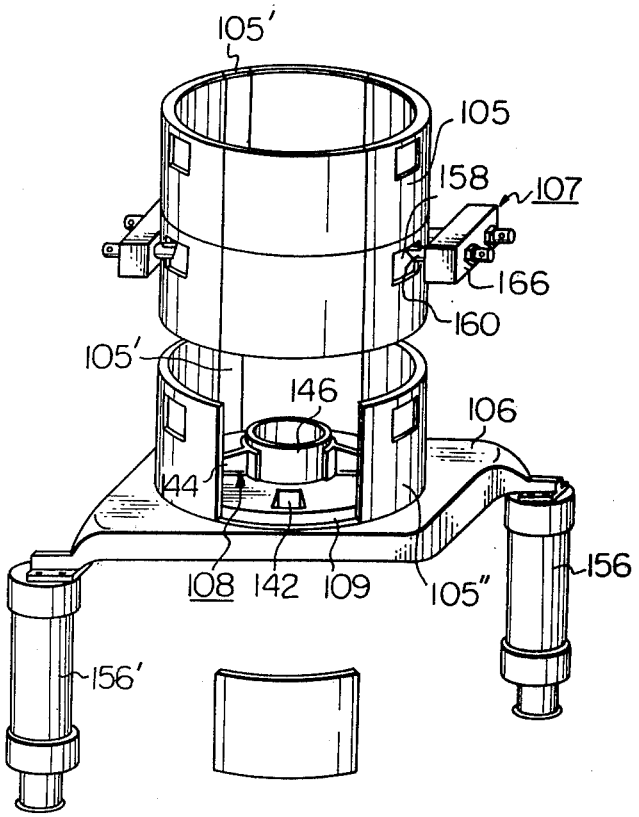
Figure 15:
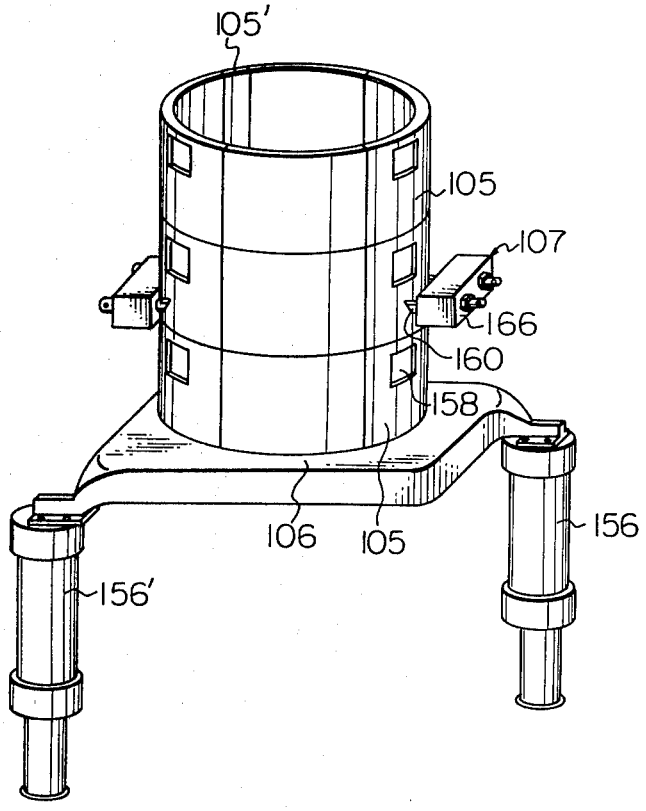
Figure 16:
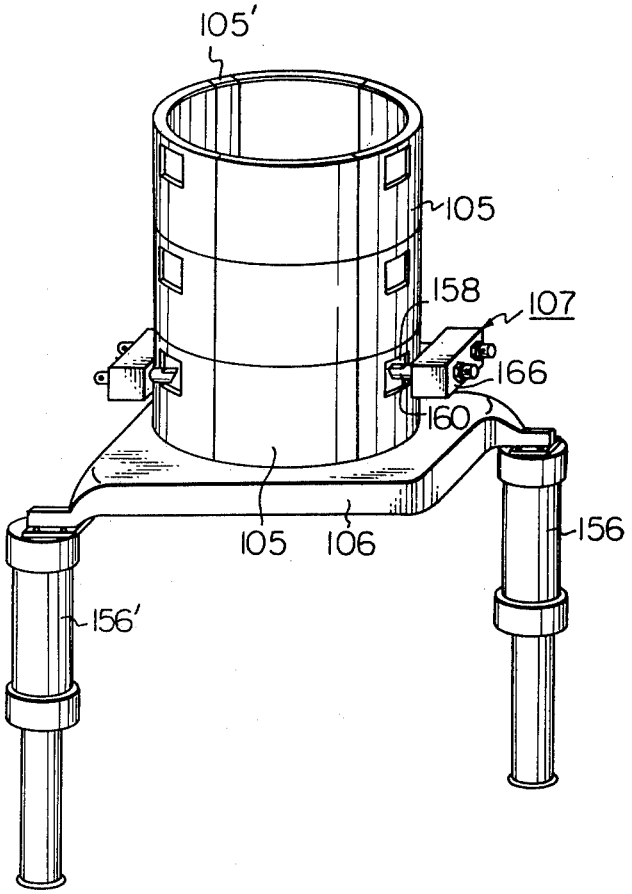

The newly added frame segment 105'' as shown in FIG. 14 continues to be raised. Since the top of the holder rod 160 in the frame segments holder 107 is beveled downwardly as shown in FIG. 5, the lower edge of the depression 158 of the segment 105 immediately above the newly added segment 105'' thrusts the rod 160 aside or backwardly to detach the same therefrom. Detachment of the rod 160 may also be attained by revolving a nut 164 attached to the frame segment holder 107 to shorten the spring 162.

After the holder rod 160 is detached from the depression 158, the thrusting means further continues to be raised upwardly, carrying the series of frame segments 105 thereon. This thrusting operation is performed independently of the segment holder 107, and the holder rod 160 will be in sliding relation with the side surface of the frame segment 105 immediately above the segment 105" and then of the frame segment 105". When the depression in the newly added segment 105" reaches the level of the holder rod 160, the rod 160 will be thrusted into the depression 158 by the spring 162. Therefore, the rod 160 and in turn the frame segment holder 107 can carry the whole load of the prolonged series of frame segments 105.

The above-mentioned rock cutting operation and the side wall supporting operation are carried out alternately and repeatingly by employing the full surface cutting mechanism and the side wall supporting mechanism respectively to complete the shaft of predetermined height and having the side wall supported. Then, the bit 101 is contracted in its diameter and is lowered to be detached. The lowermost end of the series of segments is carried on an appropriate member and the cutting machine itself is removed.

Explanation will next be made with regard to the device for contracting the diameter of the bit.

Figure 17A:
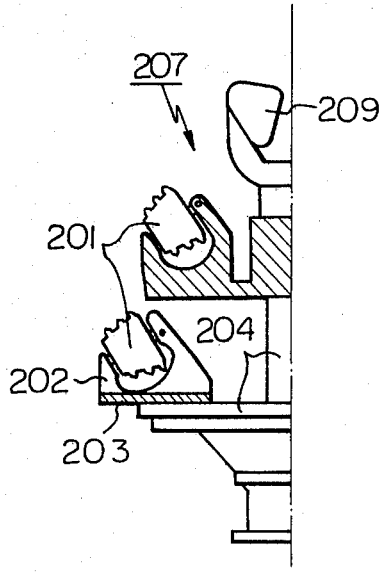
Figure 17B:
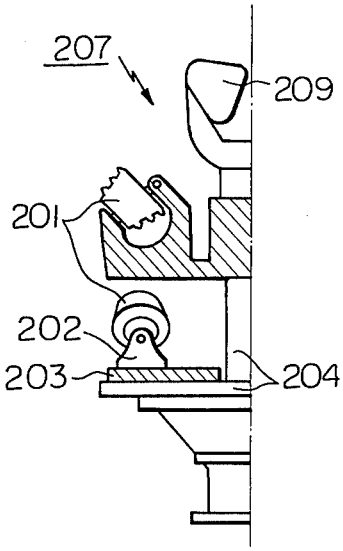

In the example shown in FIG. 17, the bit 207 has center cutter or tricon bit 214 and two levels of stepped cutters 201 for gradually enlarging the diameter of the shaft. The construction of the bit 207 is effected by turning the lower cutters 201 which are radially more projected than the upper ones.

Figure 18A:
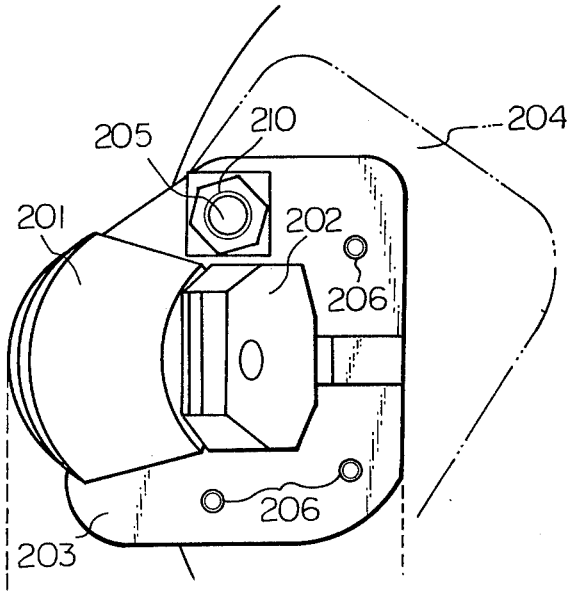
FIGS. 18*a* and 18*b* are enlarged plan and elevation views of the cutter portion shown in FIG. 17.

In cutting operation, the lower bit 201 is rotatably supported by a U shaped cutter holder 202. This cutter holder 202 is supported by a cutter shifting member 203 which is fixed to a bit column 204 by means of a pin or bolt 205 firmly fixed to the bit column 204 as shown in FIG. 18*a*. By further tightening the shifting member 203 by means of several small bolts 206, the shifting member 203 can be firmly mounted on the column 204.

Figure 18B:
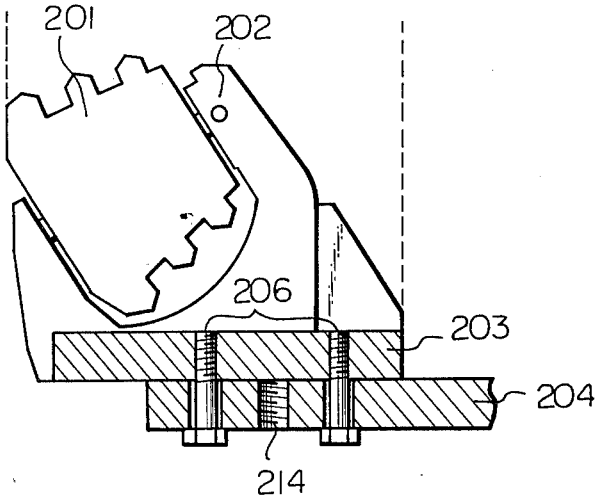
Figure 19A:
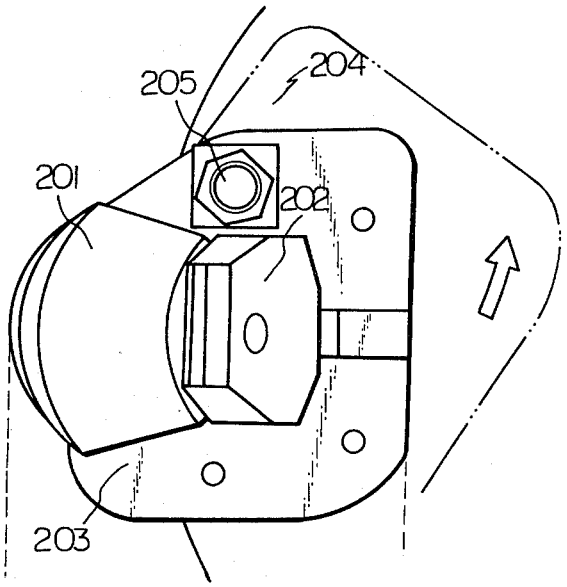
FIGS. 19*a* and 19*b* are enlarged views similar to FIGS. 18*a* and 18*b* showing further features of the cutter portion.
Figure 19B:
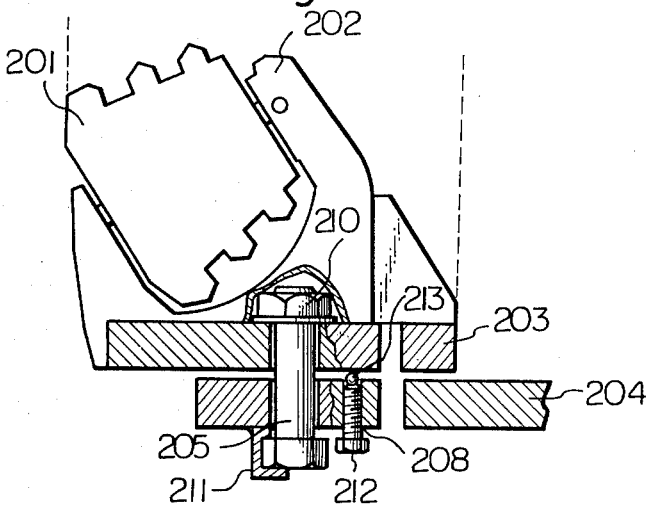

FIGS. 19*a* and 19*b* illustrate the mechanism for shifting or turning the shifting member 203. The small bolts shown in FIGS. 18*a* and 18*b* are all disengaged to leave the member 203 connected to the column 204 by the pin 205 alone. Since the head of pin 205 is held by a stopper 211 and further since a nut 210 is fixed to the upper surface of the shifting member 203 by welding or by means of key, loosening of the nut 210 will invite detachment en bloc of the shifting member 203 from the column 204 and thus the rotation or shifting of the member 203 is facilitated because the contact surface of the column 204 is decreased.

In the example shown in FIG. 19*b*, the device for contracting the diameter of the bit according to the present invention has means 208 for assisting the cutter in its rotation. This means 208 comprises a bolt 212 which carries a rotatable steel ball 213 thereon and a bolt slot 214 pierced through the column 204. The means 208 serves to prevent the generation of abrasion between the shifting member 203 and the column 204 which may otherwise occur to obstruct shifting of the shifting member 203 due to the clearance in the slot for receiving the pin 205. When the bolt 212 is threaded into the bolt slot 214, the bolt 212 will be raised to support the cutter shifting member 203 through the steel ball 213 in concert with the bolt 205. Consequently, the shift of the cutter 201 is performed very smoothly.

Figure 20A:
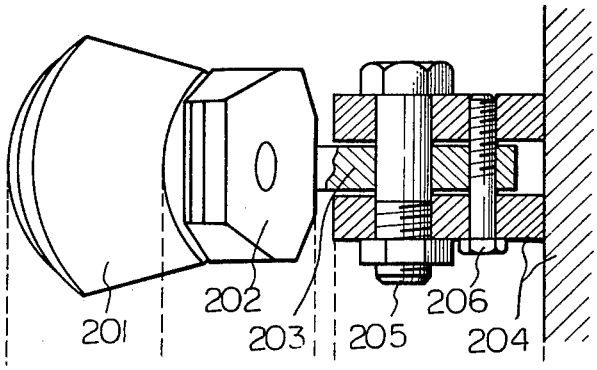
FIGS. 20*a* and 20*b* are enlarged views similar to FIGS. 18*a* and 18*b* illustrating another example of a bit contracting device.
Figure 20B:
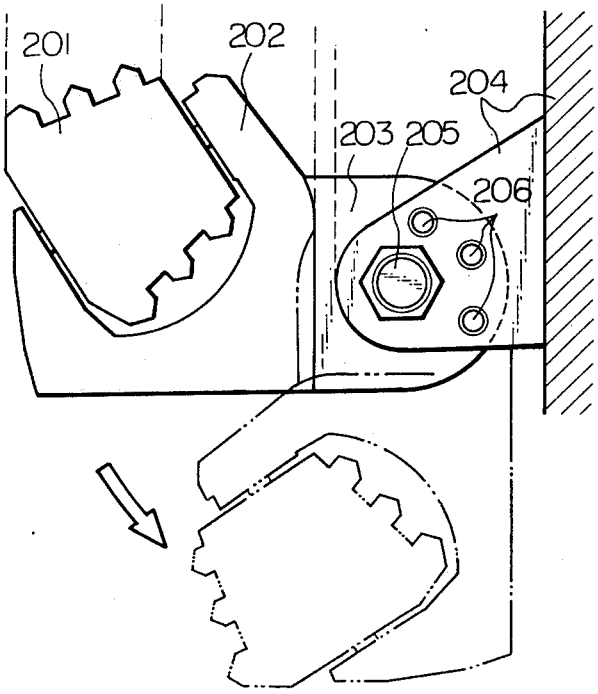

The shift of the cutter 201 may also be carried out by the device as shown in FIGS. 20*a* and 20*b*, wherein the shift is effected not in a horizontal direction but in a vertical direction. As will be understood, when the small bolts 206 are removed, the shifting member 203 will be readily located with the aid of the weight thereof from the full line position into the two dotted chain line position.

Since in this system the pin 205 and the bolt 206 must withstand heavy shearing forces, it is preferable to provide a proper means for holding the cutter 201.

What is claimed is:

1. A method for upwardly forming and excavating a shaft through destructible underground rock, said method comprising:

(a) providing a vertically movable rod thrusting means adapted to support an upwardly extending series of drill rods having at the upper end thereof a rotary bit;

(b) providing a vertically movable frame segment thrusting means adapted to support an upwardly extending series of cylindrical frame segments surrounding said series of rods;

(c) moving said rod thrusting means upwardly, thus moving said series of rods and said rotary bit upwardly into destructible rock, while rotating said series of rods and said rotary bit, and thereby cutting in said rock the full face of a shaft for a length portion thereof;

(d) moving said frame segment thrusting means upwardly, independent of the movement of said rod thrusting means, thus moving said series of frame segments upwardly into said length portion of said shaft, and thereby supporting the side wall of said shaft throughout the majority of the length thereof;

(e) interrupting rotation of said series of rods and said rotary bit;

(f) operating a rod holder supported by said frame segment thrusting means to hold said series of rods and to prevent vertical movement thereof;

(g) detaching said rod thrusting means from said series of rods and lowering said rod thrusting means;

(h) adding a new rod to said rod thrusting means, and attaching said new rod to said series of rods, to thereby form a lengthened series of rods supported by said rod thrusting means and held by said rod holder;

(i) releasing said rod holder from said lengthened series or rods;

(j) holding said series of frame segments to prevent vertical movement thereof by a frame segment holder positioned exteriorly of said series of frame segments;

(k) detaching said frame segment thrusting means from said series of frame segments and lowering said frame segment thrusting means;

(l) fabricating a new frame segment on said frame segment thrusting means, and attaching said new frame segment to said series of frame segments, to thereby form a lengthened series of frame segments supported by said frame segment thrusting means; and (m) repeating said steps (c) through (l) until said shaft is formed to a desired height and then terminating the forming and excavating operation.

2. A method as claimed in claim 1, further comprising after terminating said forming and excavating operation, contracting the diameter of said rotary bit, and withdrawing the thus contracted rotary bit downwardly from said shaft through said series of frame segments.

3. A method as claimed in claim 2, further comprising, after said rotary bit is withdrawn from said shaft, mounting a shaft top supporting tool on a series of rods supported on said rod thrusting means, and thrusting said tool upwardly to the exposed roof of said shaft by operating said rod thrusting means, thereby supporting said roof by said tool.

4. A method as claimed in claim 3, wherein said tool has an umbrella-like configuration, and said step of thrusting includes spreading said tool outwardly against said roof by pressing said tool thereagainst.

5. An apparatus for upwardly forming and excavating a shaft through destructible underground rock, said apparatus comprising:

a series of drill rods;

a rotary bit detachably mounted on an upper end of said series of rods for drilling a shaft upwardly through destructible rock;

a series of cylindrical frame segments for supporting the side wall of the shaft, each said frame segment being fabricated from plural cylindrical segment members;

vertically movable rod thrusting means for supporting said series of rods and said rotary bit and for moving said series of rods and said rotary bit upwardly into the destructible rock;

vertically movable frame segment thrusting means, operable independently of said rod thrusting means, for supporting said series of frame segments and for moving said series of frame segments upwardly into the shaft;

rod holder means, supported by said frame segment thrusting means, for selectively holding said series of rods and preventing vertical movement thereof, whereby said rod thrusting means may be detached from said series of rods and a new rod may be added thereto; and frame segment holding means, supported exteriorly of said frame segment thrusting means, for holding said series of frame segments and preventing vertical movement thereof, whereby said frame segment thrusting means may be detached from said series of frame segments and a new frame segment may be added thereto.

6. An apparatus as claimed in claim 5, further comprising means for discharging loose rock cut out during the drilling operation, said discharging means comprising a motor driven rotary scraper mounted on said frame segment thrusting means.

7. An apparatus as claimed in claim 5, further comprising means, mounted on said frame segment thrusting means, for supporting said new frame segment to be added to said series of frame segments for rotation with respect to said frame segment thrusting means.

8. An apparatus as claimed in claim 7, wherein said rotation supporting means comprises a rotary base rotatably mounted above said frame segment thrusting means, said new frame segment being supported on said rotary base, and springs between said frame segment thrusting means and said rotary base, whereby when said frame segment thrusting means supports said series of frame segments, said springs are compressed, such that said rotary base rests on and is nonrotatable with respect to said frame segment thrusting means.

9. An apparatus as claimed in claim 5, further comprising means for contracting the diameter of said rotary bit.

* * * * *